United States Patent [19]

Geller

[11] Patent Number: 4,616,833

[45] Date of Patent: Oct. 14, 1986

[54] TARGET SHOOTING GAME WITH PHOTOELECTRIC ORIENTATION SENSING APPARATUS

[75] Inventor: David A. Geller, Chicago, Ill.

[73] Assignee: Wico Corporation, Niles, Ill.

[21] Appl. No.: 710,394

[22] Filed: Mar. 11, 1985

[51] Int. Cl.[4] ..... A63F 9/02

[52] U.S. Cl. ..... 273/313; 33/1 L; 33/1 PT; 250/221; 250/231 SE; 273/316

[58] Field of Search ..... 273/313, 316, 148 B; 33/1 L, 1 PT, DIG. 3; 250/211 K, 221, 229, 231 GY, 224, 231 SE, 578; 340/347 P

[56] References Cited

U.S. PATENT DOCUMENTS

| | | | |
|---|---|---|---|
| Re. 27,728 | 8/1973 | Kosker et al. . | |
| 1,954,509 | 4/1934 | Yates . | |
| 2,275,150 | 3/1942 | Kenney et al. . | |
| 2,527,326 | 10/1950 | New . | |
| 2,747,797 | 5/1956 | Beaumont | 33/1 L X |
| 2,845,270 | 7/1958 | Durant | 273/316 X |
| 2,934,634 | 4/1960 | Hellberg . | |
| 3,798,795 | 3/1974 | Michelsen . | |
| 3,814,199 | 6/1974 | Jones | 250/229 X |
| 4,148,014 | 4/1979 | Burson | 273/148 B X |
| 4,150,897 | 4/1979 | Roberts, Jr. et al. . | |
| 4,250,378 | 2/1981 | Mutton | 250/221 |
| 4,355,902 | 10/1982 | Feist . | |
| 4,382,250 | 5/1983 | Radaelli | 250/231 SE |
| 4,533,827 | 8/1985 | Fincher | 250/221 X |

*Primary Examiner*—Anton O. Oechsle
*Attorney, Agent, or Firm*—Emrich & Dithmar

[57] ABSTRACT

The apparatus senses the absolute elevation and azimuth of a device, such as a gun in an arcade target shooting game. The gun is fixed to a shaft which is pivotable about horizontal and vertical axes and which is connected by two linkage assemblies, respectively, to two rotatably mounted encoder plates for rotating them, respectively, in response to pivoting of the gun about the two axes. Each plate has a plurality of apertures arranged in seven concentric rings in accordance with the Gray code, the arcs respectively intercepting seven light beams which are directed to seven photodetectors. At different rotational positions of the plate, different ones of the detectors will sense light. The apertures are arranged to produce discrete coded indications of each one-degree increment of movement of the gun over a range of about 90°.

6 Claims, 7 Drawing Figures

TARGET SHOOTING GAME WITH PHOTOELECTRIC ORIENTATION SENSING APPARATUS

BACKGROUND OF THE INVENTION

The present invention relates to orientation sensing apparatus and, in particular, to apparatus for sensing the orientation of a member which is capable of several different types of movement. The invention has particular application to devices which are pivotally movable about mutually perpendicular axes, such as a gun in an arcade target shooting game which is variable in elevation and azimuth for aiming purposes.

There are several different types of target shooting games. In one type the gun fires a "projectile", such as a beam of light, which strikes the target if the gun is properly aimed. In this type of device the accuracy of the aim is directly observable, and there is no need to measure the orientation of the gun.

In another type of game which is electronically operated, the gun does not fire a "projectile". Rather, the targets are disposed at known predetermined locations, and whether a target is "hit" or not is determined by whether or not the gun is properly aimed at the target location. In order to determine this, it is necessary to sense and measure the orientation of the gun and determine whether or not the aiming direction corresponding to that orientation also corresponds to a target location.

Various types of position control mechanisms have been used in arcade games, and particularly video-type arcade games. Thus, joysticks have been utilized for controlling the movement of an object, such as a cursor on a video screen, along horizontal and vertical axes. These devices sense and record relative movement, but they cannot determine absolute position. Thus, the direction and extent of movement of the joystick or trackball device corresponds to the direction and extent of movement of a controlled object, such as a video screen cursor and, in the case of a trackball, the rate of movement of the controlled object also corresponds to the rate of movement of the trackball. But in such devices, the zero reference point is wherever the movement of the device happens to start, and there is no means for determining the position of the device with respect to a fixed or permanent reference.

There have also been provided optical systems for sensing the position of a movable object with respect to a predetermined axis, by establishing a light beam which moves with the object and sweeps an encoding grid which quantizes various positions throughout the range of movement. But such devices have not been provided for determining absolute orientation of an object which undergoes plural ranges of movement.

SUMMARY OF THE INVENTION

It is a general object of the present invention to provide an improved orientation sensing apparatus which avoids the disadvantanges of prior devices while affording additional structural and operating advantages.

An important object of the invention is the provision of an orientation sensing apparatus which is capable of sensing the absolute orientation of a device which undergoes multi-dimensional movement.

In connection with the foregoing object, it is another object of the invention to provide an orientation sensing apparatus of the type set forth, which is of relatively simple and economical construction, and which is very accurate.

Still another object of the invention is the provision of an orientation sensing apparatus of the type set forth which utilizes photoelectric sensing means but does not require movement of the photoelectric sensing means.

Still another object of the invention is the provision of a target shooting game which incorporates an orientation sensing apparatus of the type set forth.

These and other objects of the invention are attained by providing apparatus for sensing the orientation of a member movable parallel to a plurality of predetermined planes, the apparatus comprising: a plurality of photoelectric means equal in number to the planes, each of the photoelectric means including light source means for projecting a beam of light and light detecting means disposed for detecting the beam, a plurality of encoding means equal in number to and respectively corresponding to the photoelectric means, each of the encoding means being positioned for intercepting the corresponding light beam, means for effecting relative movement between each the encoding means and its corresponding light beam in response to movement of the movable member parallel to the corresponding plane, each of the encoding means cooperating with the corresponding photoelectric means for generating signals indicative of the absolute position of the movable member with respect to a predetermined reference position, whereby the signals from the plurality of photoelectric means cooperate accurately to define the absolute orientation of the movable member.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantanges should be readily understood and appreciated.

DESCRIPTION OF THE PREFERRED EMBODIMENT

Figure 1:
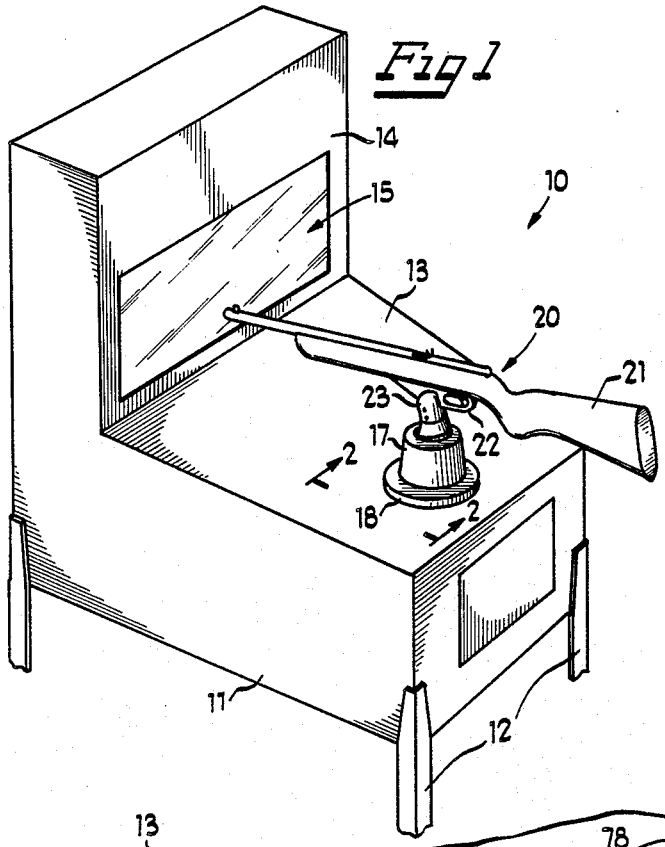
FIG. 1 is a perspective view of a target shooting arcade game incorporating an orientation sensing apparatus in accordance with the present invention.

Referring to FIG. 1, there is illustrated a target shooting game, generally designated by the numeral 10, including a gun orientation sensing assembly 20 constructed in accordance with and embodying the features of the present invention. The target shooting game 10 includes a lower cabinet 11, which is of generally box-like construction, and includes a top panel or deck 13. Integral with the lower cabinet 11 and extending upwardly therefrom at the rear end thereof is an upper cabinet 14 in which is housed a scoring and target assembly 15 visible to the player. Preferably the target shooting game 10 is of the electronic type wherein the targets are fixed in position. More specifically, movement of the targets may be simulated by providing, for each type of target, a plurality of target representations and illuminating them sequentially at a rapid rate to give the illusion of movement. A "hit" can be scored only on the target position which is illuminated.

Figure 2:
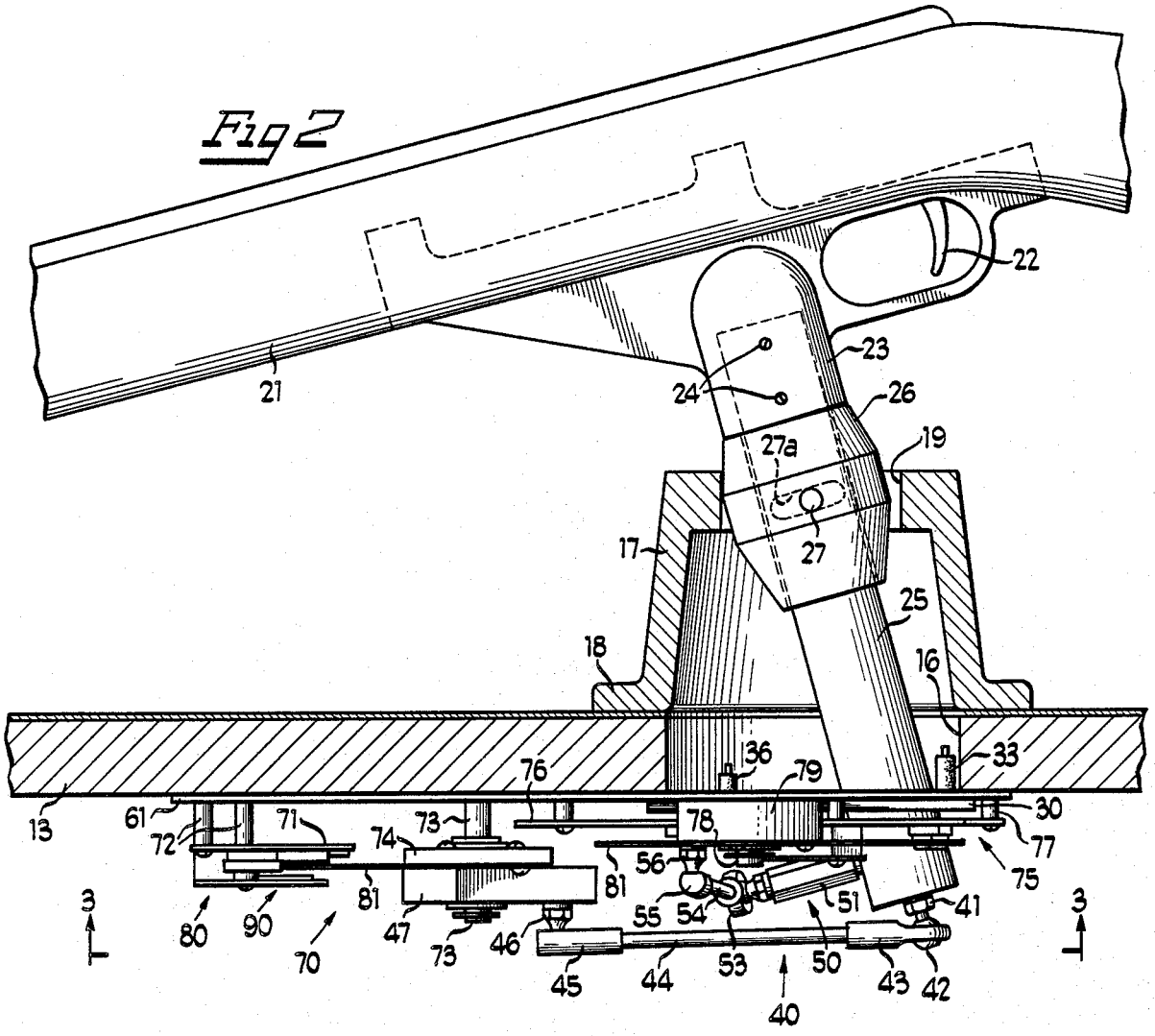
FIG. 2 is an enlarged fragmentary view in vertical section taken along the line 2—2 in FIG. 1 and illustrating the orientation sensing mechanism.
Figure 6:
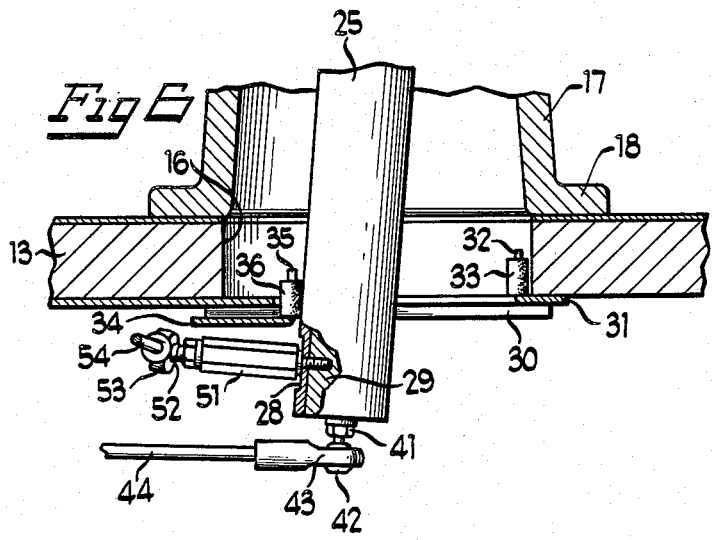
FIG. 6 is a fragmentary sectional view of a portion of the orientation sensing apparatus of FIG. 2, illustrating the apparatus in another position.

Referring also to FIGS. 2 and 6 of the drawings, there is formed in the top panel 13 an elongated slot or opening 16 over which is mounted a hollow turret 17, which is generally in the shape of an inverted cup. The turret 17 has an annular attachment flange 18 extending radially outwardly therefrom around the lower end thereof for attachment by suitable means to the upper surface of the top panel 13. The turret 17 has a circular opening 19 formed in the upper end thereof.

The gun orientation sensing assembly 20 includes a rifle 21 with a trigger 22. The rifle 21 is aimed in standard fashion and is "fired" by pulling the trigger 22. Preferably, the rifle 21 is of the type which does not emit a "projectile", such as a beam of light. Rather, the trigger 22 actuates a switch (not shown) which is electrically coupled to the scoring and target assembly 15. Preferably, the scoring and target assembly 15 includes a suitable microprocessor into which is programmed the coordinates the positions of each of the targets. The coordinates of the location toward which the rifle 21 is aimed is sensed in a manner to be described more fully below, and when these coordinates, at the instant the trigger 22 is pulled, correspond to the coordinates of the target illuminated at that instant, a "hit" is scored, in a known manner.

In order that the orientation of the rifle 21, and, therefore, the direction in which it is aimed, may be sensed, the rifle 21 is integral with a coupling socket 23 which is secured, as by screws 24, to the upper end of an elongated cylindrical support tube 25. The support tube 25 extends downwardly through the opening 19 in the turret 17 and, more particularly, extends through a pivot sleeve 26 which is mounted for pivotal movement about the axis of a shaft 27, which extends diametrically across the opening 19 in the turret 17 and is secured thereto. The shaft 27 may extend through diametrically opposed slots **27*a* in the support tube 25 (one shown in FIG. 2), each of the slots 27*a* having a width only very slightly greater than the diameter of the shaft 27, but being elongated circumferentially of the support tube 25 to accommodate limited rotational movement of the support tube 25 about its longitudinal axis through a range of approximately 90°, while at the same time preventing axial movement of the support tube 25**.

Thus, it will be appreciated that the rifle 21 is capable of two types of movement, viz., a pivotal movement in a vertical plane about the axis of the shaft 27, and a pivotal movement about the axis of the support tube 25 in planes perpendicular to that axis, these two axes being disposed perpendicular to each other. Pivotal movement about the axis of the shaft 27 changes the elevation of the rifle 21, while pivotal movement about the axis of the support tube 25 changes the azimuth of the rifle 21. The support tube 25 extends downwardly through the opening 16 in the top panel 13 and a predetermined slight distance therebelow, the length of the opening 16 being such as to permit limited pivotal movement of the rifle 21 about the axis of the shaft 27 through a range of at least 90°. The outer surface of the support tube 25 has a recess 28 therein adjacent to the lower end thereof, this lower end being closed by a plug 29 which is received in the support tube 25 and fixedly secured thereto by suitable means (see FIG. 6).

Figure 3:
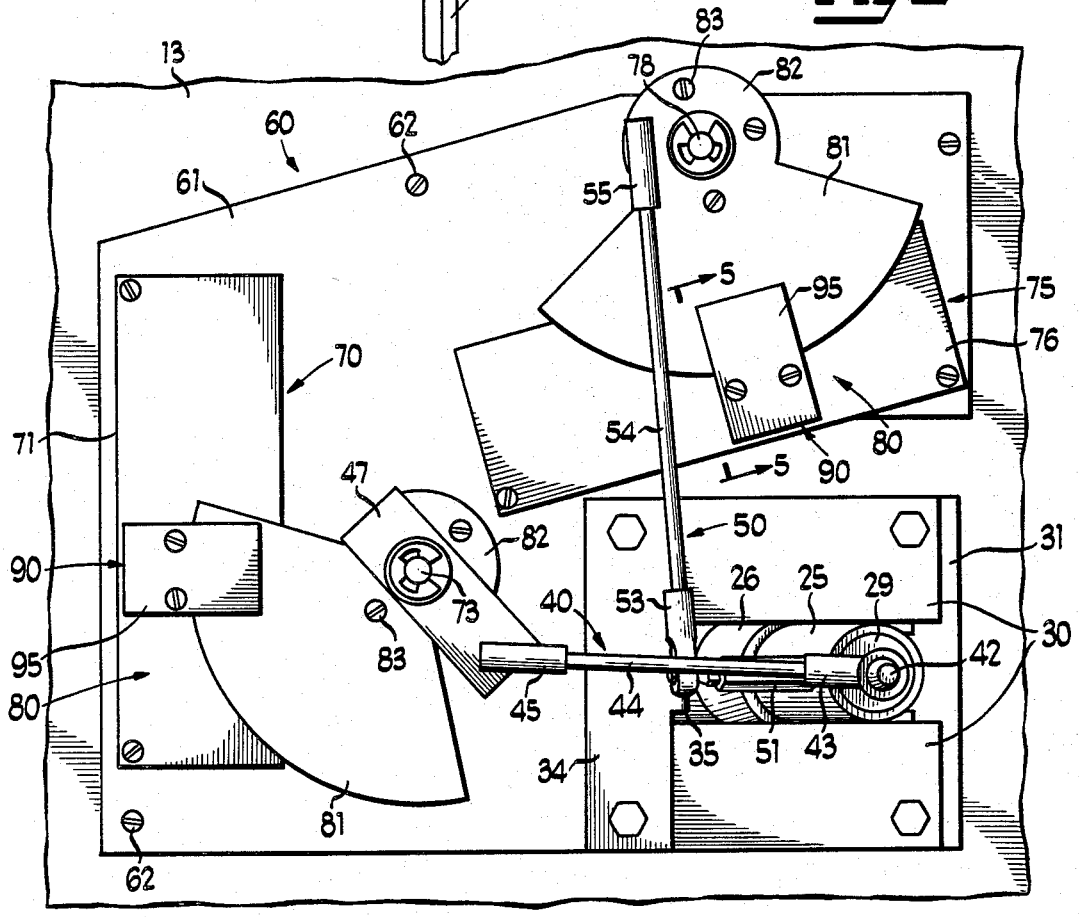
FIG. 3 is a fragmentary bottom plan view of the orientation sensing mechanism of FIG. 2, taken generally along the line 3—3 therein.

Referring now also to FIG. 3, there is fixedly secured to the underside of the top panel 13 a pair of rectangular retaining plates 30, respectively disposed along opposite side edges of the opening 16. A stop bracket 31 is clamped between the top panel 13 and the retaining plates 30 at one end thereof, the stop bracket 31 having an integral upstanding stop finger 32 projecting upwardly into the opening 16 and surrounded with a resilient cushion 33. Similarly, a stop bracket 34 spans and is fixedly secured to the retaining plates 30 at the other end thereof, the stop bracket 34 having an upstanding stop finger 35 which projects upwardly into the opening 16 and is surrounded by a resilient cushion 36 (see FIGS. 2 and 6). The stop fingers 32 and 35 are respectively disposed adjacent to opposite ends of the opening 16 and for engagement with the support tube 25 to limit the pivotal movement thereof about the axis of the shaft 27 to a range of approximately 90°.

The lower end of the support tube 25 is coupled by an elevation linkage 40 and an azimuth linkage 50, respectively, to an elevation encoding unit 70 and an azimuth encoding unit 75 of an encoding assembly 60. More specifically, the elevation linkage 40 includes a stud 41 fixedly secured to the plug 29 in the support tube 25 and projecting axially downwardly therefrom. The stud 41 is provided at its lower end with a ball 42 which cooperates with a socket 43 to provide a universal ball-and-socket joint. The socket 43 is fixedly secured to one end of an elongated extension arm 44, the other end of which is fixedly secured to a swivel socket 45 which is coupled for pivotal movement about the axis of a swivel pin 46 depending from and fixedly secured to a rectangular coupling block 47, adjacent to one end thereof.

Similarly, the azimuth linkage 50 includes an elongated stud 51 fixedly secured to the support tube 25 at the recess 28 and extending radially outwardly therefrom. The stud 51 carries a ball 52 at its outer end which is disposed for cooperation with a socket 53 to provide a universal ball-and-socket joint. The socket 53 is fixedly secured to one end of an elongated extension arm 54, the other end of which is fixedly secured to a swivel socket 55 disposed for pivotal movement about the axis of a swivel pin 56 which projects radially upwardly therefrom (see FIG. 2).

The encoding assembly 60 includes a large flat base plate 61 which is fixedly secured to the underside of the top panel 13 by suitable fasteners 62. The encoding units 70 and 75 are mounted on the base plate 61. More particularly, the elevation encoding unit 70 includes a rectangular circuit board 71 disposed beneath and parallel to the base plate 61, secured thereto by suitable fasteners and preferably spaced therebelow a predetermined distance by spacers 72, respectively surrounding the fasteners (see FIG. 2). Also extending vertically downwardly from the base plate 61 is a pivot shaft 73, on which is rotatably mounted an attachment plate 74. The lower end of the pivot shaft 73 extends through a complementary opening in the coupling block 47, which is secured to the attachment plate 74 by suitable means, and both may be retained in place on the pivot shaft 73, as by an E-ring or the like. Both the coupling block 47 and the attachment plate 74 are rotatable about the axis of the pivot shaft 73.

In like manner, the azimuth encoding unit 75 includes an elongated rectangular circuit board 76, which is disposed beneath and parallel to the base plate 61 and secured thereto by suitable fasteners, and preferably spaced therefrom a predetermined distance by spacers 77, respectively surrounding the fasteners (see FIG. 2). Also secured to the base plate 61 and depending therefrom is a pivot shaft 78 on which is rotatably mounted a pivot plate 79. The pivot plate 79 may be retained on the pivot shaft 78 by an E-ring or the like. The swivel pin 56 is fixedly secured to the pivot plate 79 and depends therefrom.

Figure 4:
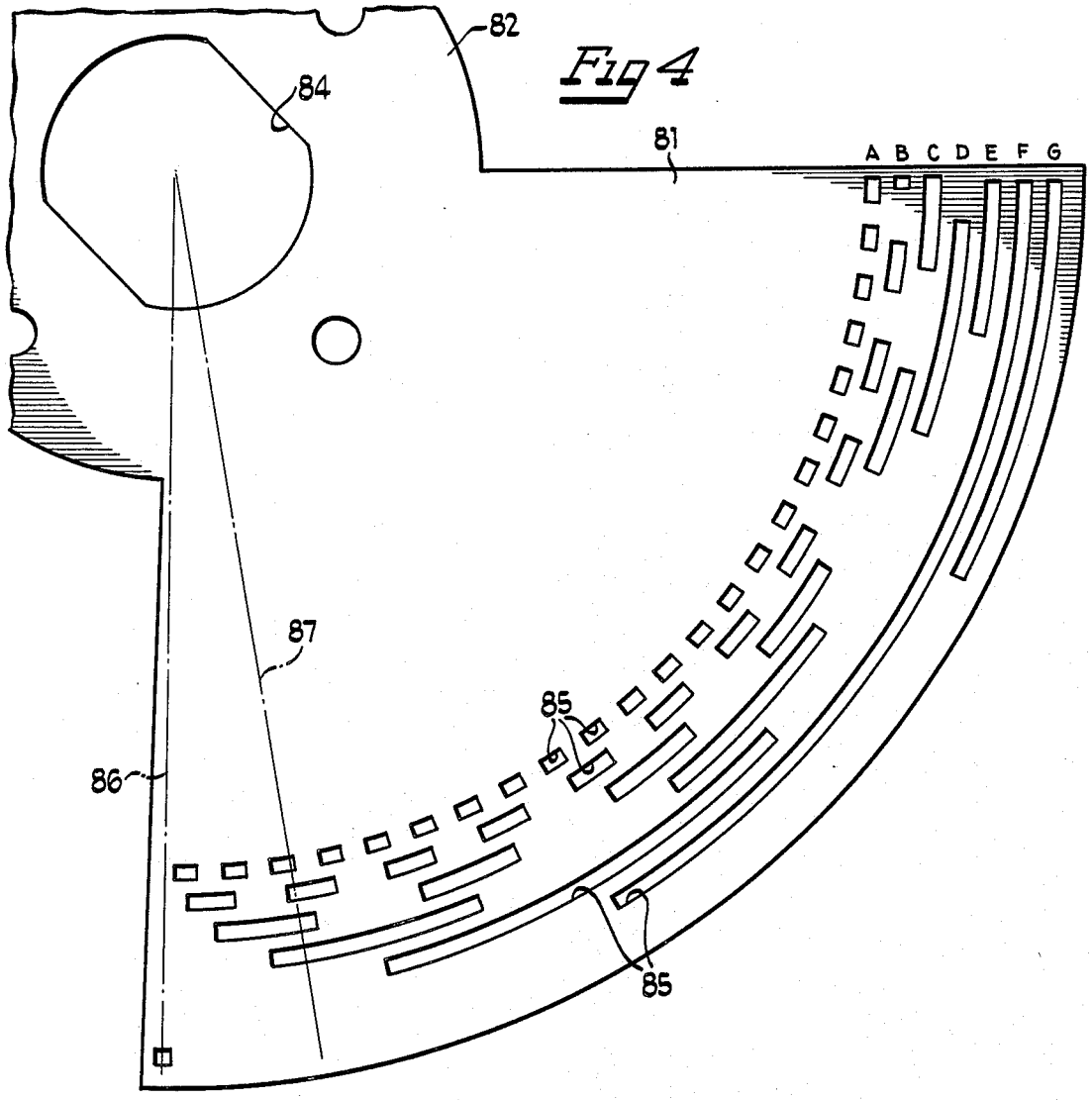
FIG. 4 is a further enlarged, fragmentary bottom plan view of one of the encoding discs of the present invention.
Figure 5:
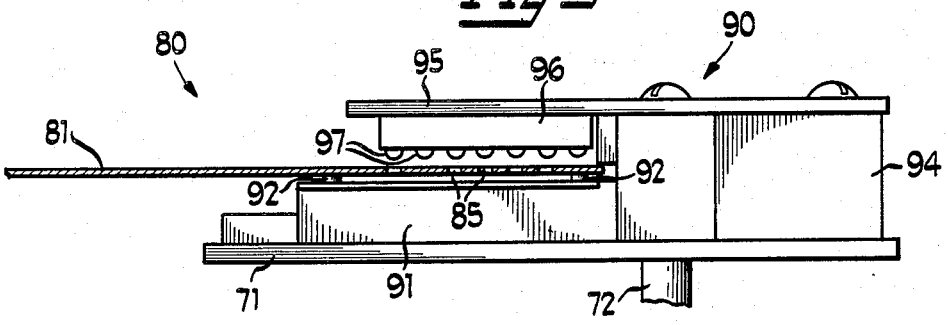
FIG. 5 is a further enlarged, fragmentary view in vertical section taken along the line 5—5 in FIG. 3.

Referring now also to FIGS. 4 and 5, each of the encoding units 70 and 75 includes an optical assembly 80 identical in construction. Each optical assembly 80 includes a flat encoding plate 81 which is generally in the shape of a quarter sector of a circle and is provided with a part-circular hub portion 82. The hub portion 82 of one of the encoding plates 81 is sandwiched between the coupling block 47 and the attachment plate 74, and is fixedly secured to the latter, as by fasteners 83. The other encoding plate 81 is fixedly secured by fasteners 83 to the underside of the pivot plate 79. The hub portion 82 of each encoding plate 81 has an aperture 84 therethrough (see FIG. 4) for receiving the pivot shafts 73 and 78, respectively. Thus, it will be appreciated that the encoding plate 81 of the elevation encoding unit 70 pivots as a unit with the coupling block 47 and the attachment plate 74 about the axis of the pivot shaft 73, while the encoding plate 81 of the azimuth encoding unit 75 pivots as a unit with the pivot plate 79 about the axis of the pivot shaft 78. In this regard, it will be appreciated that the hub portion 82 of this latter encoding plate 81 has a suitable aperture therethrough (not shown) for receiving the swivel pin 56.

Referring in particular to FIG. 4, a plurality of apertures 85 are formed through each encoding plate 81 adjacent to the outer arcuate perimeter thereof. The apertures 85 are of varying lengths and are arranged in a plurality of arcuate rows concentric with the encoding plate 81. These rows are preferably seven in number, and are respectively designated A, B, C, D, E, F and G. The apertures 85 are arranged in accordance with a predetermined code, preferably the Gray code, with the number of rows of apertures 85 corresponding to the number of positions in the Gray code. Thus, it will be appreciated that with a sevel-row configuration, Gray code representations of decimal numbers from 0 to 127 can be provided. More specifically, the apertures 85 are spaced so as to provide a discrete coded representation for each one degree increment of rotation of the encoding plate 81. Since the encoding plate 81 is rotatable through an arc of approximately 90°, seven rows of apertures 85 are necessary in order to provide representations for each one-degree increment of rotation.

When light is passed by an aperture 85 for actuating the associated phototransistor 93, this represents a binary "1", while when the light beam is blocked so that the phototransistor 93 is deactuated, this corresponds to a binary "0". Thus, for example, the imaginary radial line 86 in FIG. 4 intercepts a single aperture 85 in row G, which corresponds to the Gray code number "0000001", which in turns corresponds to the decimal number "0" for the 0-degree position of the encoding plate 81. The imaginary radial line 87 intercepts apertures 85 in rows A through D, but is blocked in rows E through G. This produces the Gray code number "1111000", which corresponds to the decimal number "10" for the 10-degree position of the encoding plate 81. Thus, there is a 10-degree angle between the imaginary lines 86 and 87.

Each of the optical assemblies 80 includes a photoelectric unit 90. Each photoelectric unit 90 includes a detector block 91 mounted on the associated circuit board 71 or 76 (see FIG. 5) and provided with a pair of spacers 92 depending therefrom. The detector block 91 includes a plurality of phototransistors 93 (see FIG. 7), equal in number to the number of rows of apertures 85 in the encoding plate 81 (seven in this use), and arranged in a straight line. Also mounted on the associated circuit board 71 or 76 is a spacer block 94, which carries a circuit board 95 on which is mounted an emitter block 96, including a plurality of infrared light emitting diodes (LED'S) 97, equal in number to the phototransistors 93 and aligned respectively therewith for optical coupling thereto.

The parts of each optical assembly 80 are arranged so that the encoding plate 81 extends between the phototransistors 93 and the LED'S 97 of the associated photoelectric unit 90, as is best illustrated in FIG. 5, with the rows of phototransistors 93 and LED'S 97 arranged radially of the encoder plate 81 and respectively aligned with the seven rows A–G of apertures 85. Thus, it will be appreciated that, as the encoding plate 81 rotates, each row of apertures 85 alternately passes the light beam from the associated LED 97 when an aperture 85 is aligned therewith, blocks the light beam when the solid area between apertures 85 is aligned therewith, for respectively actuating or deactuating the associated phototransistor 93 to generate an output signal. The beams from the LED's 97 may be considered as cooperating to form a composite "beam" which is encoded by the encoding plate 81. Thus, the output signals from the seven phototransistors 93 will, at any given instant, constitute a coded representation of the angular position of the encoding plate 81.

Figure 7:
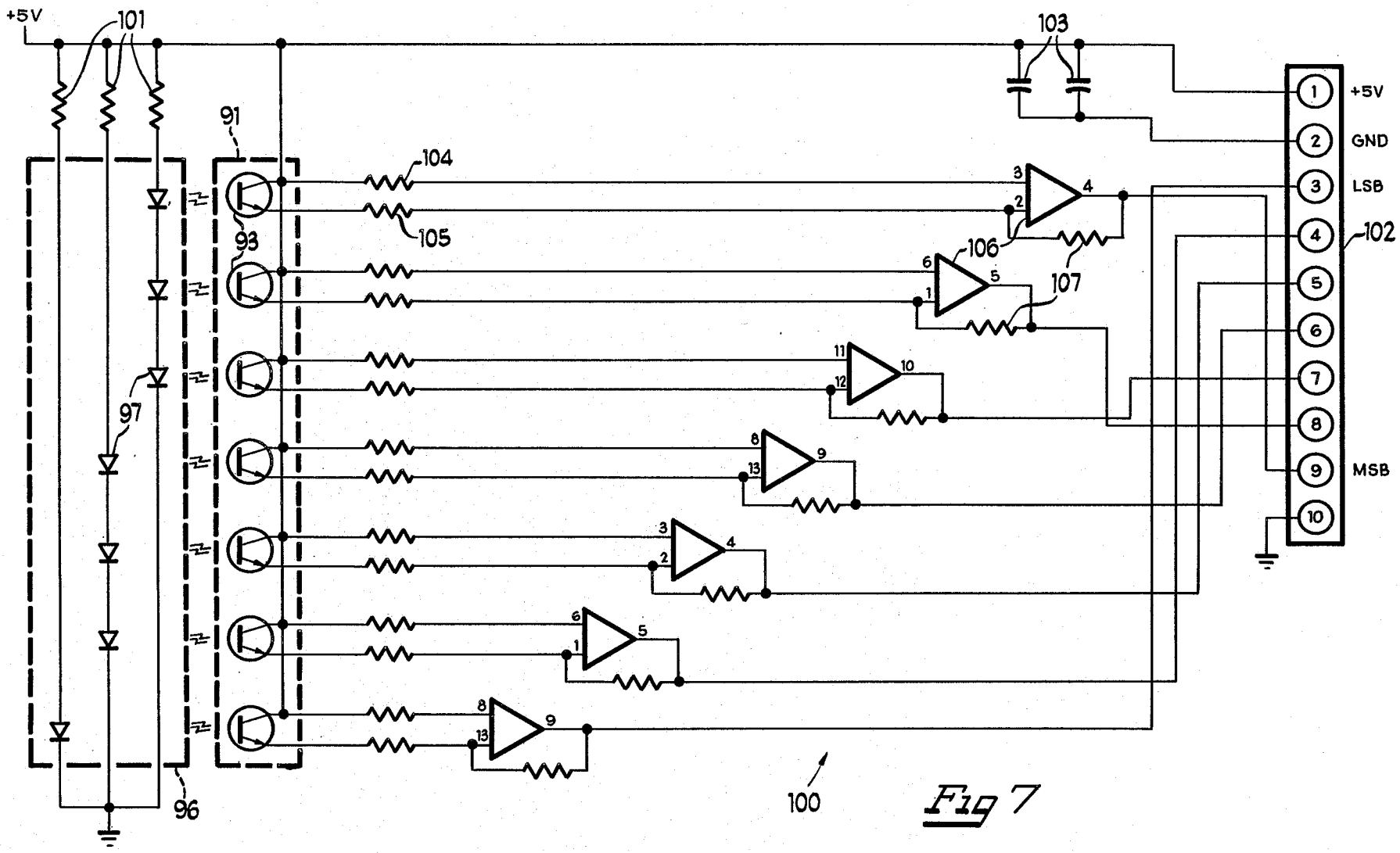
FIG. 7 is a schematic circuit diagram of the control circuitry for the orientation sensing apparatus of the present invention.

In FIG. 7 there is illustrated a control circuit 100. The control circuit 100 includes three currentlimiting resistors 101 connected in parallel between a +5 VDC source and ground. Three of the LED'S 97 are connected in series with one of the resistors 101, three are connected in series a second resistor 101 and the final LED 97 is connected in series with the third resistor 101. The +5 VDC supply is also connected to pin 1 of a 10-pin terminal block 102. Two capacitors 103 are connected in parallel between the +5 VDC supply and pin 2 of the terminal block 102. Each of the phototransistors 93 has its collector and emitter respectively connected through resistors 104 and 105 to the two input terminals of a corresponding one of seven identical operational amplifiers 106, which may be formed as part of a common integrated circuit. Each operational amplifier 106 has a feedback resistor 107 connected between one of its input terminals and its output terminal. The output terminals of the operational amplifiers 106 are respectively connected to pins 3–9 of the terminal block 102, pin 10 thereof being connected to ground.

The operation of the gun orientation sensing assembly 20 will now be described in detail. When the rifle 21 is moved up and down about the axis of the shaft 27 for changing its elevation, the elevation linkage 40 responds to this pivotal movement of the support tube 25 for effecting a corresponding rotational movement of the encoding plate 81 of the associated elevation encoding unit 70. The gun orientation sensing assembly 20 is calibrated so that the lowest elevation of the rifle 21 corresponds to the 0-degree position of the associated encoding plate 81, while the highest elevation corresponds to the 90-degree position. These positions correspond to vertical positions on the scoring and target assembly 15. Thus, at any given instant of time, the elevation encoding unit 70 will generate an output signal in Gray code corresponding to the absolute elevation of the rifle 21. More particularly, the light beams from the LED'S 97 which are passed by the apertures 85 in the encoding plate 81 actuate the corresponding phototransistors 93 to produce output signals which, in turn, energize the associated operational amplifiers 106 to produce output signals therefrom which appear at the associated pins of the terminal block 102. It will be appreciated that the terminal block 102 is coupled by suitable means (not shown) to the remaining circuitry of the target shooting game 10.

In like manner, when the azimuth of the rifle 21 is changed by rotation thereof about the axis of the support tube 25, the azimuth linkage 50 responds to this movement for effecting a corresponding rotation of the encoding plate 81 of the azimuth encoding unit 75. In this regard, the left-most position of the rifle 21, as viewed by the player, corresponds to the 0-degree position of the encoding plate 81, while the right-most position of the rifle 21 corresponds to the 90-degree position of the encoding plate 81. Again, each 1-degree increment of rotation of the encoding plate 81 corresponds to an absolute azimuth position of the rifle 21 and a corresponding azimuth position on the scoring and target assembly 15. The azimuth encoding unit 75 operates to generate output signals in the same manner as was described above with respect to the elevation encoding unit 70.

Thus, it can be seen that the gun orientation sensing assembly 20 produces encoded output signals which correspond to the absolute elevation and azimuth of the rifle 21, which signals taken together define the absolute orientation of the rifle 21. While in the present invention the rotational movement of the rifle 21 about each of its two pivot axes is limited to about 90°, it will be appreciated that any desired degree of rotation could be provided. Also, while the apertures 85 in the encoding plates 81 are arranged in accordance with a seven-position Gray code, it will be appreciated that any other coding scheme could be utilized. The advantage of the Gray code is that it minimizes the chance for error in any given code representation, since only one of the seven code positions changes with each 1-degree change in position of the encoding plate 81. While the apertures 85 have been arranged to provided discrete code representations for each 1-degree increment of movement, it will be appreciated that any other desired degree of precision could be provided.

From the foregoing, it can be seen that there has been provided an improved orientation sensing assembly which is of relatively simple and economical construction, senses absolute orientation with respect to two perpendicular axes, and provides a photoelectric sensing mechanism wherein the photoelectric elements remain stationary.

I claim:

1. In a target shooting game including a target assembly and a shooting device movable parallel to a plurality of predetermined planes for aiming, apparatus for sensing the direction in which the shooting device is aimed comprising: a plurality of photoelectric means equal in number to said planes, each of said photoelectric means including light source means for projecting a beam of light and light detecting means disposed for detecting said beam, a plurality of encoding members equal in number to and respectively corresponding to said photoelectric means and movable in parallel planes, each of said encoding members being positioned for intercepting the corresponding light beam and having a plurality of apertures therethrough dimensioned and arranged in accordance with a predetermined code, and a plurality of linkage assemblies connecting the shooting device respectively to said encoding members, each of said linkage assemblies being responsive to movement of the shooting device parallel to only a corresponding one of said planes to effect movement of only the corresponding one of said encoding members for varying the positions on said encoding members at which said light beams are intercepted, each of said encoding members blocking selected portions of the corresponding light beam for encoding said beam to indicate the distance between the position on said encoding member at which said light beam is intercepted and a reference position thereon, each said light detecting means being responsive to the corresponding encoded light beam for generating signals indicative of the absolute position of the shooting device with respect to a predetermined reference position, whereby the signals from said plurality of light detecting means cooperate accurately to define the absolute orientation of the shooting device.

2. The target shooting game of claim 1, wherein said shooting device is pivotally movable about perpendicular axes.

3. The target shooting game of claim 2, wherein the shooting device is movable to vary the azimuth and elevation thereof.

4. The target shooting game of claim 1, wherein each of said photoelectric means includes a plurality of light source means for respectively projecting a plurality of light beams, and a like plurality of light detecting means for respectively detecting said light beams.

5. The target shooting game of claim 4, wherein each of said encoding members has the apertures therethrough arranged in a plurality of concentric rings.

6. The target shooting game of claim 5, wherein said apertures are arranged in accordance with the Gray code.

* * * * *